US005461967A

United States Patent [19]

Burkett et al.

[11] Patent Number: 5,461,967

[45] Date of Patent: Oct. 31, 1995

[54] SWASH PLATE COMPRESSOR WITH IMPROVED PISTON ALIGNMENT

[75] Inventors: Michael J. Burkett, Lockport; Nikolaos A. Adonakis, Grand Island, both of N.Y.

[73] Assignee: General Motors Corporation, Detroit, Mich.

[21] Appl. No.: 398,335

[22] Filed: Mar. 3, 1995

[51] Int. Cl.[6] ..... F01B 3/00

[52] U.S. Cl. ..... 92/71; 92/165 R; 417/269; 74/60

[58] Field of Search ..... 92/71, 12.2, 165 R; 417/269; 91/499; 74/60

[56] References Cited

U.S. PATENT DOCUMENTS

| | | | |
|---|---|---|---|
| 4,351,227 | 9/1982 | Copp, Jr. et al. | 92/71 |
| 4,789,311 | 12/1988 | Ikeda et al. | 92/71 |
| 5,174,728 | 12/1992 | Kimura et al. | 417/269 |
| 5,201,261 | 4/1993 | Kayukawa et al. | 417/269 |

FOREIGN PATENT DOCUMENTS

| | | | |
|---|---|---|---|
| 0918583 | 4/1982 | U.S.S.R. | 92/71 |
| 1216422 | 3/1986 | U.S.S.R. | 91/499 |

OTHER PUBLICATIONS

U.S. Ser. No. 08/338298 filed 14 Nov. 1994 "Swash Plate Compressor With Improved Piston Stability", Burkett et al.

U.S. Ser. No. 08/210489 filed 21 Mar. 1994 "Compact Refrigerant Compressor" Burkett et al.

*Primary Examiner*—Thomas E. Denion

*Attorney, Agent, or Firm*—Patrick M. Griffin

[57] ABSTRACT

A swash plate driven piston compressor includes means to maintain the pistons on their respective cylinder bore axes. A resilient alignment ring bears on the radial inner sides of the pistons at a point near the back ends of the pistons. The ring moves passively with the swash plate, without affecting its operation. The ring prevents the pistons from tipping radially inwardly and off their axes as they retract. The piston design is not appreciably changed, and the ring fits within otherwise empty space within the compressor housing.

3 Claims, 4 Drawing Sheets

SWASH PLATE COMPRESSOR WITH IMPROVED PISTON ALIGNMENT

This invention relates to air conditioning compressors in general, and specifically to compressors of the type having one sided pistons driven by a swash plate.

BACKGROUND OF THE INVENTION

Automotive air conditioning compressors of the swash plate type reciprocate a plurality of cylindrical pistons back and forth within close fitting cylinder bores. The edge of the nutating swash plate slides through, and rocks within, a ball-shoe joint formed in the body of the piston. The swash plate, being disposed at an angle to the shaft, produces a somewhat unbalanced force on the piston, a force that tends to tilt the pistons off axis, especially at full retraction. The ball-shoe joint, since it has radial clearance built in to it, is not capable of preventing the pistons from cocking radially inwardly and away from the axes of the cylinder bores as they retract. There are also side loads acting on a piston that can tend to drive it off axis in the lateral direction, perpendicular to the radial direction. In many compressors, the pistons are double sided, with two opposed ends sliding back and forth simultaneously in opposed, collinear cylinder bores. An example may be seen in co-assigned U.S. Pat. No. 4,351,227. With double ended pistons, the piston body as a whole is kept securely on axis by the fact that its two widely spaced ends ride back and forth in the opposed bores, like a beam supported at both ends.

It is also possible to drive single ended pistons with a swash plate, a design suitable for smaller capacity, more axially compact compressors. With only the front end supported in the bore, and the back end relatively unsupported, the piston is more subject to tilting off axis as it retracts, especially radially inwardly. One proposed solution is the addition of an extra swash plate, running in tandem to the first, with rod and ball joints extending from the back ends of the pistons to the tandem plate to help guide and align the pistons as they retract. This is a very expensive proposal, and would require a longer compressor housing. An extra swash plate and rod joints would also add a good deal of extra weight.

Two other potential solutions to the problem of piston axis misalignment, disclosed in co pending, co-assigned U.S. patent applications, provide new piston designs which have inherently better axial alignment. U.S. Ser. No. 08/210,489, filed Mar. 21, 1994, and allowed Dec. 6, 1994, adds stability with a piston that is non circular in cross section, as is its matching cylinder bore. This design is primarily directed toward radial compressor compactness, however. U.S. Ser. No. 08/338,298, filed Nov. 14, 1994, discloses a piston which, while still cylindrical, has an effectively longer front end. Therefore, when fully retracted on the backstroke, there is more piston front end surface area still remaining in contact with the cylinder bore, and thus more resistance to the piston cocking off axis. Both designs require significant changes to the standard piston shape and structure, especially to the piston front end or head. A way to provide better piston alignment without significant change to the shape or length of the piston, and without increasing compressor housing length, would be desirable. Such a design could be easily retro fitted to existing compressors.

SUMMARY OF THE INVENTION

The invention provides a swash plate compressor with single ended pistons that have improved stability, but which have a standard shape and size.

In the embodiment disclosed, each piston has a substantially solid, cylindrical body and front end, of standard diameter and length. The front end reciprocates back and forth within a standard round cylinder bore. The radially inner surfaces of the pistons, near the piston back ends, extend out into the crank case, facing the central compressor drive shaft. The pistons are completely standard in construction except for a socket in the form of a radially inwardly facing slot cut near the back end of each piston. A circular alignment ring surrounds the central shaft and is axially and radially captured in all of the piston sockets, oriented parallel to the swash plate. The diameter of the alignment ring is matched to the sockets such that, should pistons tend to tip off their respective cylinder bore axes, they are resisted by the alignment ring, which keeps them on axis. The alignment ring is light and compact, and moves passively with the pistons, without interfering with their retraction or with the operation of the swash plate.

DESCRIPTION OF THE PREFERRED EMBODIMENT

These and other features of the invention will appear from the following written description, and from the drawings, in which.

Figure 1:
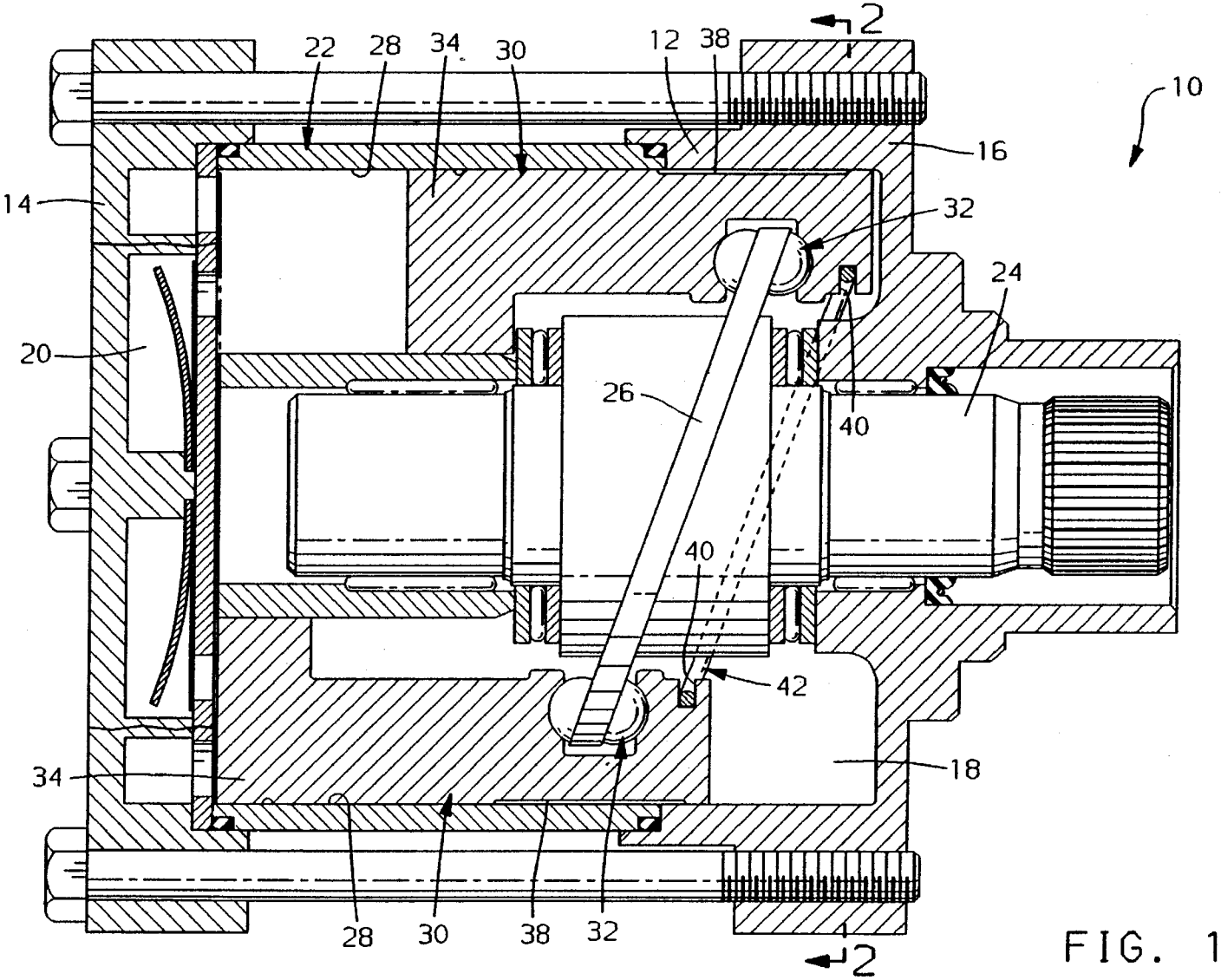
FIG. 1 is a cross section through a compressor made according to the invention, showing an upper piston retracted and a lower piston extended.
Figure 2:
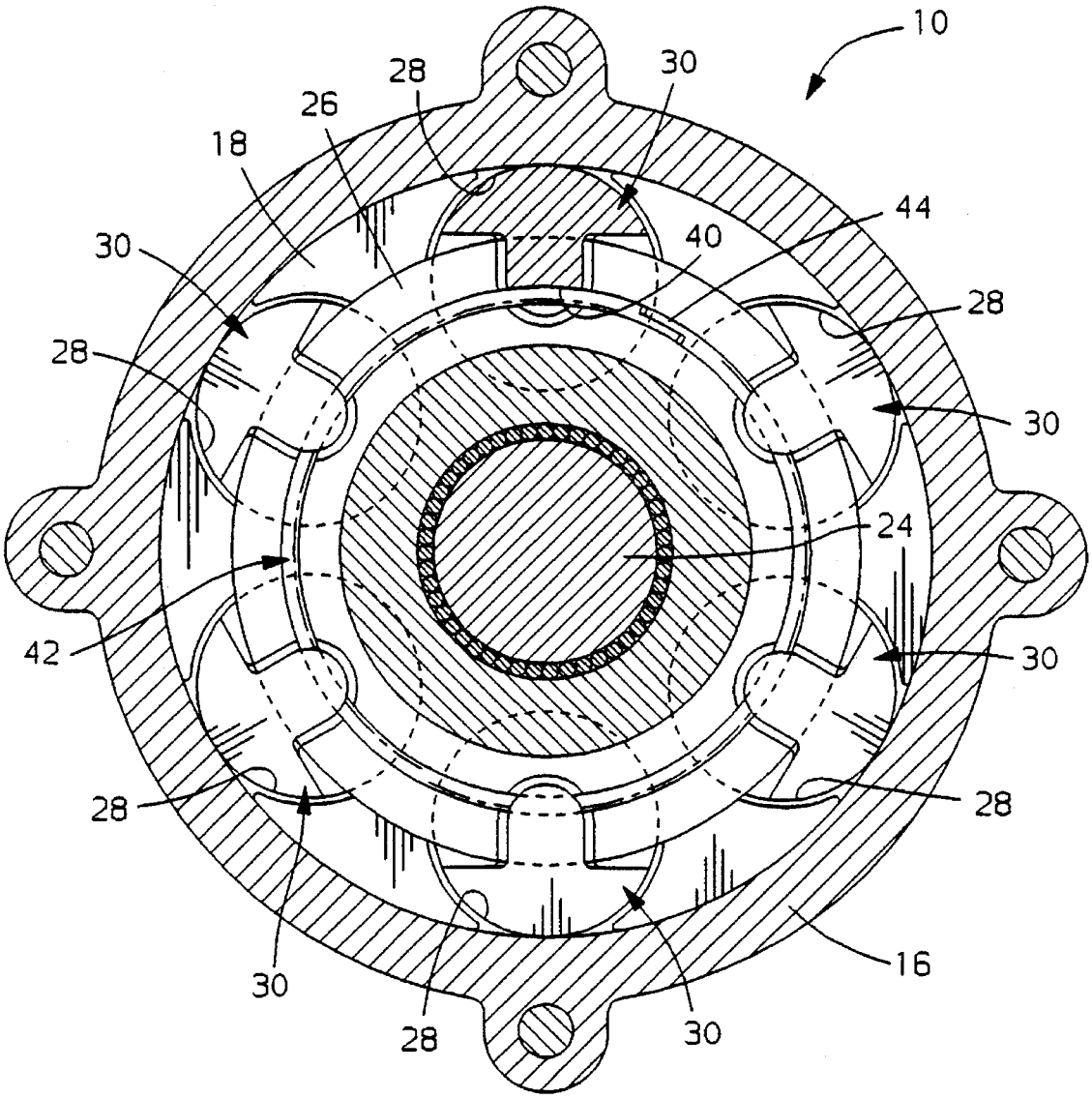
FIG. 2 is a cross sectional view of the compressor taken along the plane indicated by the line 2—2 of FIG. 1.

Referring first to FIGS. 1 and 2, a compressor made according to the invention, indicated generally at 10, is basically conventional in overall diameter, length and shape. A cylindrical housing 12, closed by a separate rear head 14 and integral front head 16, encloses a sealed interior volume generally called the crankcase 18. Rear head 14 would have refrigerant inlet and outlet ports, not illustrated. The inlet admits low pressure refrigerant, while a discharge passage 20, directs compressed refrigerant out to the outlet. Housing 12 mates to a cylinder block, indicated generally at 22. The center of block 22 rotatably supports a central drive shaft 24, which in turn supports a solid, nutating swash plate 26. Within cylinder block 22 are several evenly spaced cylindrical bores 28 arrayed about and parallel to the central axis of shaft 24. Each bore 28 opens at one end to crankcase 18, and opens at the other end, indirectly, to the front head discharge passage 20.

Figure 7:
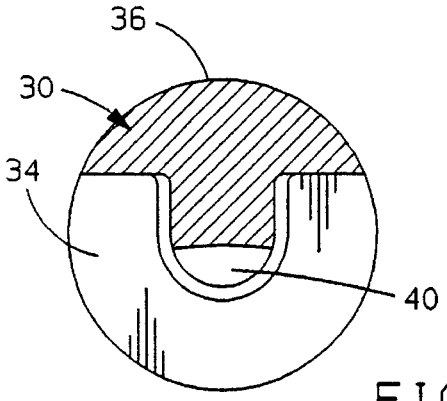
FIG. 7 is a cross sectional view of a piston taken along the plane indicated by the line 7—7 of FIG. 6.
Figure 8:
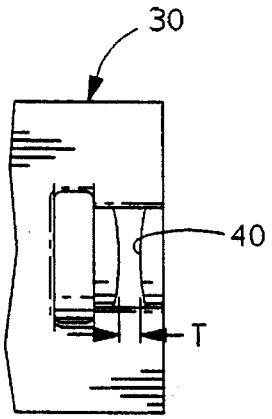
FIG. 8 is a view of the back end of a piston taken along the plane indicated by the line 8—8 in FIG. 7.

Referring next to FIGS. 5 through 8, the cylinder bores 28 each contain a piston 30, one of which is indicated generally at 30. Piston 30 is basically a solid cylinder, although its radially inwardly facing surface, which faces the drive shaft 24, is largely machined away, both to reduce weight and to create a socket for a conventional ball-shoe assembly 32. The ball-shoe assembly 32 rides on and over the edge of the nutating swash plate 26 near the back end of piston 30, translating the axial component of the swash plate's 26 nutating motion to the pistons 30. The piston front end or head 34 is a complete cylinder, although relatively axially short. The remaining radially outer surface 36 of each piston 30 covers approximately 180 degrees and runs the whole length of piston 30, but for a localized lubrication carrying groove 38. Finally, near the end of piston 30, generally parallel to and axially outboard of the ball-shoe assembly 32, is a ring socket 40, which is not found in a conventional piston. Ring socket 40, as best seen in FIGS. 7 and 8, is a relatively thin, radially inwardly facing slot which has a semicircular bottom surface, all of which bottom surfaces lie on a circle when the pistons 30 are all aligned on the axes of the cylinder bores 28. As seen in FIG. 8, the walls of the slot are basically parallel, with a least thickness T, but flare out slightly at the edges. There is generally enough solid material available at the end of a piston 30 to machine in such a socket 40, which, as described in more detail below, would not see nearly as much stress as would the more robust ball-shoe assembly 32. The location of socket 40 shown, outboard of the swash plate 26, gives it a significant axial spacing from the piston front end 34, which has a significance described in more detail below.

Referring next to FIGS. 1 and 2, as the back ends of the pistons 30 are driven back and forth by the swash plate 26, the piston heads 34 reciprocate within and along the central axes of the cylinder bores 28. The piston outer surfaces 36 simultaneously slide within and along the radially outer surfaces of the bores 28. In addition, the back end of surface 36 slides along the inner surface of housing 12, at least that portion which is outboard of the lubrication groove 38. As it reciprocates, the piston's front end 34 provides only limited resistance to any tendency of the piston 30 to tilt off the axis of its bore 28. This is especially so at full retraction, as shown in FIG. 1, when the (upper) piston 30 extends out into crankcase 18, largely unsupported. The edge of the swash plate 26 slides through the ball-shoe assembly 32 with a large radial outer clearance, and so provides little resistance to radially inward piston cocking. A new component, acting in cooperation with the swash plate 26, helps maintain piston alignment, as described next.

Figure 3:
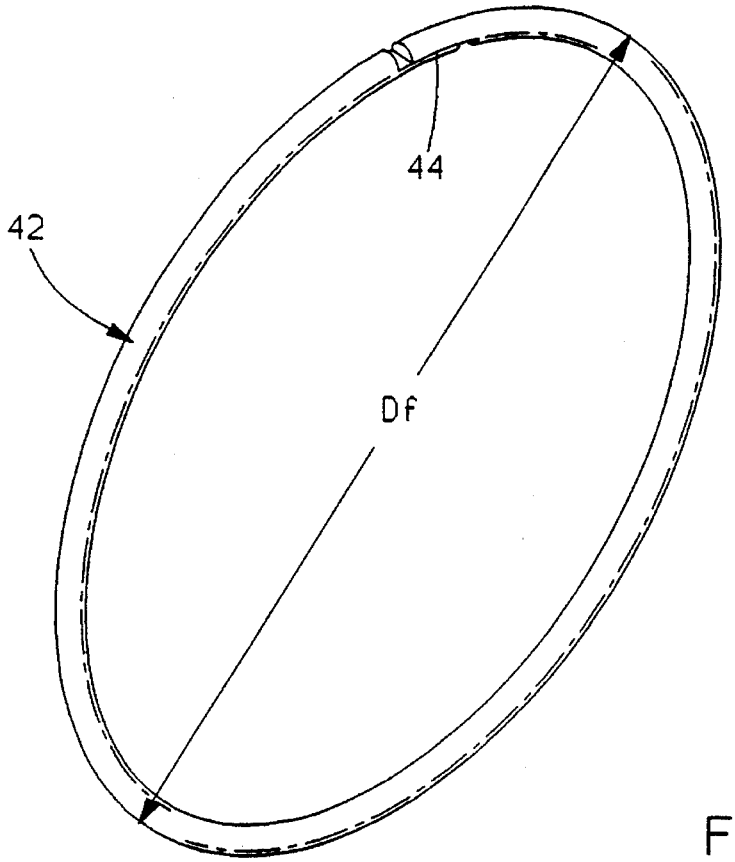
FIG. 3 is a perspective view of the alignment ring alone.
Figure 4:
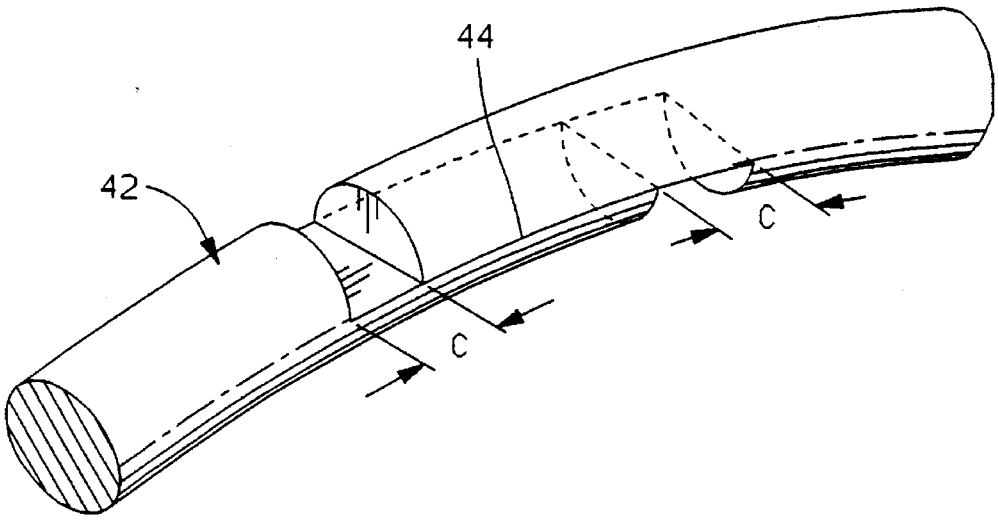
FIG. 4 is an enlargement of just the overlapped ends of the alignment ring.
Figure 5:
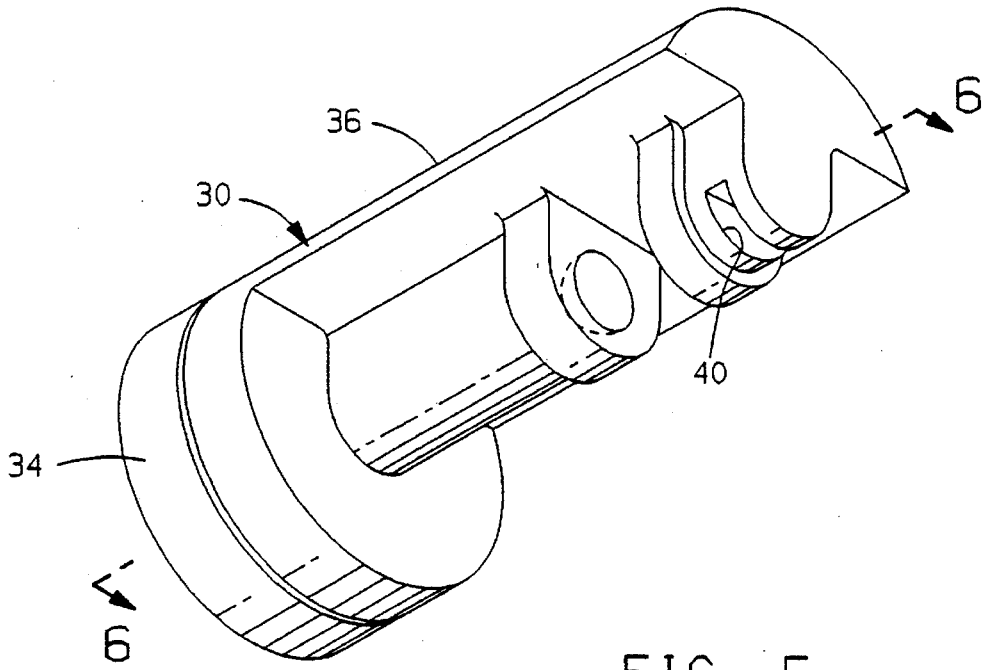
FIG. 5 is a perspective view of a piston alone.
Figure 6:
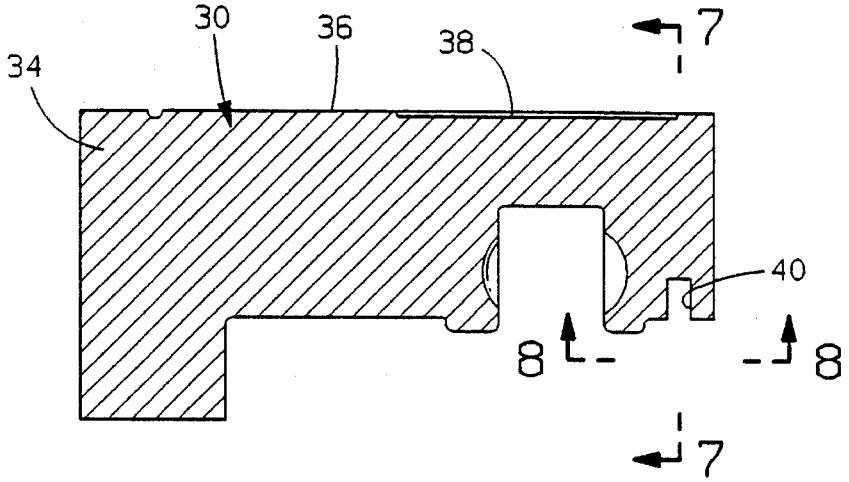
FIG. 6 is a cross sectional view of a piston taken along the plane indicated by the line 6—6 of FIG. 5.

Referring next to FIGS. 3, 4 and 2, an expansion ring, indicated generally at 42, is a circular ring that surrounds the shaft 24, within housing 12, at a location as far outboard of the piston front ends 34 as possible, preferably very near the back end of the pistons 30. Ring 42 is resilient steel, and is also circular in cross section, with a thickness substantially equal to the thickness T of the piston's ring socket 40. As such, it is much lighter and smaller than swash plate 26. The two ends of ring 42 are machined partially flat to create a lap joint 44, best seen in FIG. 4. In the free, fully expanded state of ring 42 illustrated, there is clearance C at each end of the lap joint 44. Ring 42, in its free state, has a diameter Df that is just slightly greater than the imaginary circle, referred to above, on which all the bottom surfaces of the rings sockets 40 lie when the pistons 30 are all perfectly aligned on axis. When fully contracted or compressed, the clearance C would be closed up at each end of the lap joint 44, making ring 42 small enough in diameter to fit radially inside of, and then expand out into, the ring sockets 40, as shown in FIG. 2. Ring 42 has no particular preferred angular position within the sockets 40, except that it would be best that the lap joint 44 not be located directly in a piston ring socket 40. After installation, the ring 42 expands out to a diameter slightly smaller than its free state diameter, thereby maintaining a small, constant, tension pushing radially outwardly, which is sufficient to keep it in firm radial contact with the piston sockets 40.

Referring again to FIGS. 1 and 2, as the swash plate 26 reciprocates the pistons 30, the alignment ring 42, since it is captured axially closely within the ring sockets 40, is moved passively along with the pistons 30, remaining parallel to the swash plate 26. Ring 42 is not heavy, and does not bind or otherwise interfere with the basic action of the swash plate 26. Nor does it stress the piston sockets 40, since it moves only passively. Because of the frictional force between the constantly tensioned ring 42 and the bottom surfaces of the ring sockets 40, the ring 42 does not rotate about shaft 24 or slide through the sockets 40. Because of the close axial and radial fit, the ring 42 does not rattle within the ring sockets 40, but the flared edges of sockets 40 do allow that small portion of the ring 42 that is captured within each socket 40 to rock back and forth without binding. Should any piston 30 tend to tilt radially inwardly, that tendency would be immediately resisted by the alignment ring 42, since it sits in the sockets 40 snugly, with substantially no radial clearance. In effect, a righting moment is created by the alignment ring 42, which is assisted by its axial distance from the piston front end 34. The alignment maintaining force of ring 42 is particularly significant at full piston retraction. While the pistons' radially outer surfaces 36 are kept in somewhat more forceful contact with the matching radially outer surfaces of the bores 28, by the tension in ring 42, that force is small enough so as not to significantly increase rubbing friction and wear. The main objective is simply to resist the tendency of the pistons 30 to cock radially inwardly off axis. Therefore, the free state diameter of the ring 42 would be carefully tailored so as to be just larger than its installed diameter, and would not press out too strongly when the pistons 30 were on axis. The extra alignment force on the pistons 30 is achieved with very little change in their construction, needing only the ring socket 40 to be added. The ring 42 itself is relatively low cost, and there will typically be room enough for it behind the swash plate 26, so that the compressor housing 12 need not be lengthened. The invention can be easily retro fitted, therefore, into many existing compressors with single ended, swash plate driven pistons.

Variations in the embodiment disclosed could be made. The ring 42 shown is a simple wire loop. It would be possible to machine the ring 42 with an evenly spaced series of integral balls, one for each piston 30 and to machine each socket 40 with a matching spherical surface to capture the balls. Then, the alignment ring would be prevented absolutely from rotating about the shaft 24, and would not need the frictional force that ring 42 has to prevent sliding through the sockets 40. This, in turn, would potentially allow the alignment ring to be under no residual tension after installation, thereby causing no significant extra rubbing friction along the piston outer surfaces 36. Such ball joints on the ring would also provide very strong resistance to the pistons tilting laterally off axis. It would be possible, in a compressor housing that had sufficient room, to put an alignment ring like 42 on both sides of the swash plate 26. This would have the potential of providing even more piston alignment force, though at some extra cost. If sufficient solid metal were not available for the piston socket 40 to be cut into location shown, then it would be possible to incorporate the alignment ring into the ball-shoe assembly 32, which would be indirectly connected to the pistons, but still capable of the same function. Or, a concave groove socket could be machined axially into the end of the piston 30, which had a surface that faced radially inwardly, and into which a larger diameter ring could be snap fitted. So long as the piston ring sockets have some radially inwardly facing surface that makes close contact with a radially outwardly facing portion of a matched diameter ring, and at a point axially spaced from the front end of the pistons, then the ring will resist cocking of the pistons off axis. Other configurations could be provided for the ring lap joint 44, as well, or, potentially, the ring could be solid, if some way to install it other than contraction and expansion could be devised. Therefore, it will be understood that it is not intended to limit the invention to just the embodiment disclosed.

The embodiments of the invention in which an exclusive property or privilege is claimed are defined as follows:

1. In a compressor of the type having a series of generally cylindrical pistons arrayed within a compressor housing about a central drive shaft, each piston having a front end that reciprocates within a cylinder bore along an axis parallel to said drive shaft and a back end that is driven back and forth by a nutating swash plate on said drive shaft, an alignment means to prevent said pistons from tipping radially inwardly away from their cylinder bore axes, comprising, a substantially circular alignment ring surrounding said central axis generally parallel to said swash plate, a ring socket formed in each of said piston having a radially inwardly facing surface, said socket being adapted to receive a portion of said alignment ring with close axial and radial contact when said pistons are aligned with their respective cylinder bore axes, whereby, as said swash plate nutates, said alignment ring is carried along with said pistons, remaining parallel to said swash plate, and resisting any tendency of said pistons to cock radially inwardly away from their respective cylinder bore axes.

2. In a compressor of the type having a series of generally cylindrical pistons arrayed within a compressor housing about a central drive shaft, each piston having a front end that reciprocates within a cylinder bore along an axis parallel to said drive shaft and a back end that is driven back and forth by a nutating swash plate on said drive shaft, an alignment means to prevent said pistons from tipping radially inwardly away from their cylinder bore axes, comprising, a substantially circular, resilient alignment ring surrounding said central axis generally parallel to said swash plate, said alignment ring being resiliently contractible from a predetermined free state diameter, a ring socket formed in each of said pistons, said socket comprising a radially inwardly facing slot having a semicircular bottom surface lying on a circle slightly smaller than said ring free state diameter, whereby, said alignment ring may be contracted and installed in said piston ring sockets, after which said ring expands partially back toward its free state diameter and against said socket bottom surfaces, thereby providing a continual radially outward force on said pistons as said swash plate nutates to prevent said pistons from cocking radially inwardly away from their respective cylinder bore axes.

3. An alignment means according to claim 1 or 2 in which said ring sockets are located axially outboard of said swash plate.

* * * * *